US009489821B2

(12) United States Patent
King et al.

(10) Patent No.: US 9,489,821 B2
(45) Date of Patent: Nov. 8, 2016

(54) DEVICE AND METHOD FOR MONITORING THE PRESENCE OF AN ITEM

(71) Applicant: Google Inc., Mountain View, CA (US)

(72) Inventors: Martin T. King, Vashon Island, WA (US); Claes-Fredrik Mannby, Mercer Island, WA (US); Michael J. Smith, Seattle, WA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/074,988

(22) Filed: Nov. 8, 2013

(65) Prior Publication Data

US 2015/0170496 A1 Jun. 18, 2015

Related U.S. Application Data

(63) Continuation of application No. 13/019,739, filed on Feb. 2, 2011, now abandoned.

(60) Provisional application No. 61/301,560, filed on Feb. 4, 2010.

(51) Int. Cl.
*G08B 21/00* (2006.01)
*G08B 21/24* (2006.01)

(52) U.S. Cl.
CPC ..... *G08B 21/24* (2013.01)

(58) Field of Classification Search
CPC ... H04W 64/00; H04W 48/04; B67D 7/3236
USPC ..... 340/540, 686.1, 686.6, 539.13, 539.32, 340/539.14; 327/517
See application file for complete search history.

(56) References Cited

U.S. PATENT DOCUMENTS

| | | | | |
|---|---|---|---|---|
| 5,923,735 | A * | 7/1999 | Swartz | G07F 7/00 235/472.01 |
| 5,939,981 | A | 8/1999 | Renney | |
| 6,084,517 | A | 7/2000 | Rabanne et al. | |
| 7,295,114 | B1 * | 11/2007 | Drzaic | A62B 99/00 235/385 |
| 7,880,613 | B1 | 2/2011 | Maeng | |
| 7,996,338 | B2 | 8/2011 | Kamar | |
| 8,810,392 | B1 | 8/2014 | Teller | |
| 2001/0038330 | A1 | 11/2001 | Garcia | |
| 2003/0216969 | A1 | 11/2003 | Bauer et al. | |

(Continued)

OTHER PUBLICATIONS

Office Action issued in U.S. Appl. No. 13/019,701 on Jun. 7, 2013, 19 pages.

(Continued)

*Primary Examiner* — George Bugg
*Assistant Examiner* — Anthony D Afrifa-Kyei
(74) *Attorney, Agent, or Firm* — Fish & Richardson P.C.

(57) ABSTRACT

Exemplary methods and systems for monitoring presence of an item or items are disclosed herein. An exemplary method may be carried out by a monitoring device having a processor and a memory, and may involve determining that presence data associated with an item meets one or more criteria associated with automatically adding the item to a list of items whose presence is monitored in a particular context, and based on determining that presence data associated with the item meets the one or more criteria associated with automatically adding the item to the list of items whose presence is monitored in the particular context, adding the item to the list of items whose presence is monitored in the particular context.

25 Claims, 6 Drawing Sheets

(56) References Cited

U.S. PATENT DOCUMENTS

| | | | | |
|---|---|---|---|---|
| 2005/0134459 | A1 | 6/2005 | Glick et al. | |
| 2005/0285739 | A1 | 12/2005 | Velhal et al. | |
| 2006/0022823 | A1* | 2/2006 | Ryal | G08B 13/1418 340/572.1 |
| 2006/0033623 | A1* | 2/2006 | Hines | G08B 21/0227 340/572.1 |
| 2006/0202840 | A1 | 9/2006 | Korbonski | |
| 2007/0182555 | A1* | 8/2007 | Walker | G07G 1/0036 340/572.1 |
| 2007/0210930 | A1 | 9/2007 | Pyo et al. | |
| 2008/0086508 | A1 | 4/2008 | Ballew | |
| 2008/0174425 | A1 | 7/2008 | Torning | |
| 2008/0204233 | A1 | 8/2008 | Agrawal et al. | |
| 2009/0077675 | A1 | 3/2009 | Cabouli | |
| 2010/0039266 | A1 | 2/2010 | Faris et al. | |
| 2010/0188226 | A1 | 7/2010 | Seder et al. | |
| 2010/0289646 | A1 | 11/2010 | Raniere | |
| 2010/0302032 | A1 | 12/2010 | Abed | |
| 2011/0148625 | A1 | 6/2011 | Velusamy | |
| 2013/0001295 | A1* | 1/2013 | Goncalves | G07G 1/0063 235/375 |
| 2013/0127596 | A1* | 5/2013 | Jain | G01S 13/74 340/10.1 |
| 2014/0084060 | A1* | 3/2014 | Jain | G06Q 10/087 235/385 |

OTHER PUBLICATIONS

Office Action issued in U.S. Appl. No. 13/019,701 on Jan. 21, 2014, 14 pages.

Notice of Allowance issued in in U.S. Appl. No. 13/019,701 on Apr. 21, 2014, 6 pages.

Office Action issued in U.S. Appl. No. 14/330,383 on Sep. 15, 2015, 15 pages.

Office Action issued in U.S. Appl. No. 13/019,739 on Jan. 30, 2013, 12 pages.

Office Action issued in U.S. Appl. No. 13/019,739 on Aug. 13, 2013, 15 pages.

Office Action issued in U.S. Appl. No. 14/330,838 on Dec. 7, 2015, 9 pages.

Notice of Allowance issued in U.S. Appl. No. 14/330,838 on Dec. 23, 2015, 7 pages.

* cited by examiner

DEVICE AND METHOD FOR MONITORING THE PRESENCE OF AN ITEM

CROSS-REFERENCE TO RELATED APPLICATIONS

This application is a continuation of U.S. application Ser. No. 13/019,739, filed Feb. 2, 2011, which claims the benefit of claims priority to U.S. Provisional Application No. 61/301,560, filed on Feb. 4, 2010, the contents of which are incorporated by reference.

BACKGROUND

A person typically needs various portable items near him throughout the day. For example, a person may use his reading glasses and laptop at both his house and office, and he may need his wallet and keys wherever he goes. In the absence of such items, a person may become frustrated, inefficient, or even endangered. Such items therefore must not be forgotten, misplaced, or lost.

Despite a person's best intentions and attempts, however, it is almost inevitable that he will eventually forget or misplace something that is necessary or important for him to have near. A wallet, for example, may be forgotten at a restaurant, or keys may fall out of a pocket and slip between couch cushions. In either situation, a person may not realize that his personal item has disappeared from his presence until a later time when it is too late or too inconvenient to retrieve the missing item.

SUMMARY

Disclosed herein are methods and monitoring devices that alert a user who has or is about to misplace, forget, lose, or otherwise have an item removed from the user's presence.

In one aspect, an example method of monitoring a presence of an item may involve: (i) determining an item that is typically present in a given context, wherein the given context is indicated by two or more context signals; (ii) determining that a current context is the given context and responsively searching for a signal associated with the item, wherein the signal indicates presence of the item within a certain distance of the monitoring device; (iii) if the signal associated with the item is not detected by the monitoring device, then determining whether or not to generate an alert to a user of the monitoring device; and (iv) if the signal associated with the item is detected by the monitoring device, then monitoring continued presence of the item by sensing the signal, while the current context remains the given context.

In another aspect, an example monitoring-device system may include: (i) one or more communication components; (ii) at least one processor; (iii) a non-transitory memory; and (iv) instructions stored in the non-transitory memory and executable by the at least one processor to: (a) determine an item that is typically present in a given context, wherein the given context is indicated by two or more context signals; (b) determine that a current context is the given context and responsively cause one of the communication components to search for a signal associated with the item, wherein the signal indicates presence of the item within a certain distance of the monitoring device; (c) if the signal associated with the item is not detected, then determine whether or not to generate an alert to a user of the monitoring device; and (d) if the signal associated with the item is detected by the monitoring device, then monitor continued presence of the item by sensing the signal associated with the item, while the current context remains the given context.

In another aspect, an example monitoring-device system may include: (i) one or more communication components; (ii) at least one processor; (iii) a non-transitory memory; and (iv) instructions stored in the non-transitory memory and executable by the at least one processor to: (a) determine that two or more items are associated with each other; (b) determine an importance of the items relative to each other; (c) search for a signal associated with each of the items, wherein the signal indicates presence of the item within a certain distance of the monitoring device; (d) if the signal associated with at least one of the items is detected and the signal associated with at least another one of the items is not detected, then use the importance of the items relative to each other as a basis to determine whether or not to generate an alert to a user of the monitoring device; (e) if none of the signals associated with any of the items are detected, then generate an alert to a user of the monitoring device; and (f) if the signals associated with all of the items are detected, then monitor continued presence of the items by sensing the signals associated with the items.

These as well as other aspects, advantages, and alternatives, will become apparent to those of ordinary skill in the art by reading the following detailed description, with reference where appropriate to the accompanying drawings.

DETAILED DESCRIPTION

Figure 1:
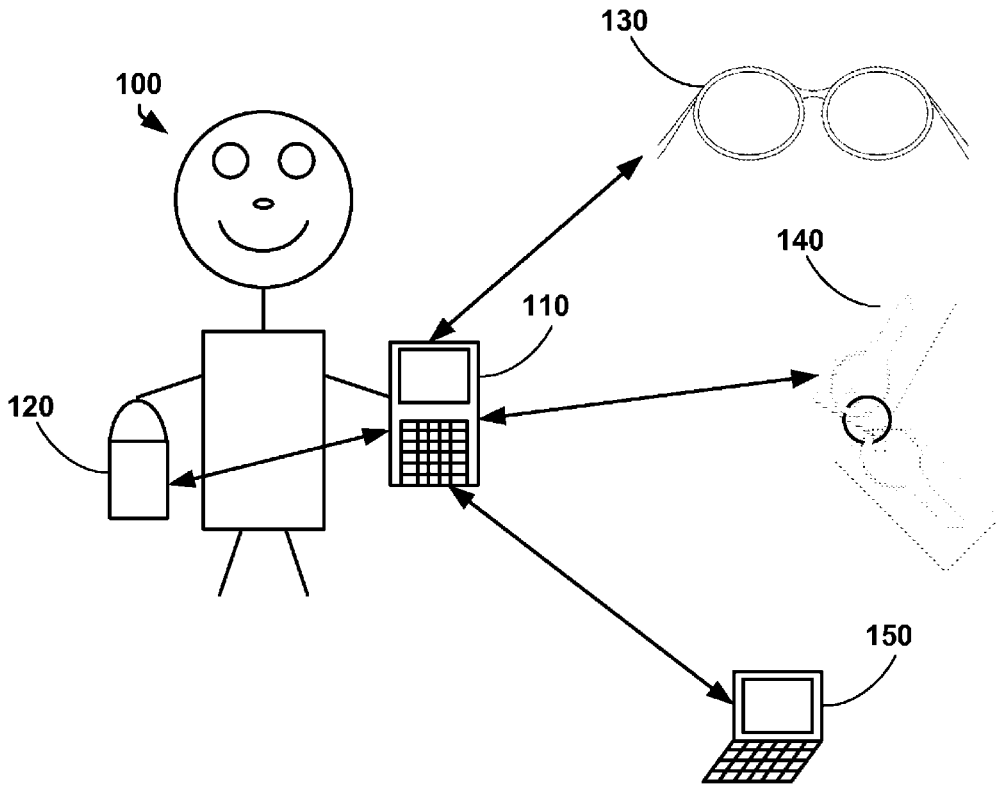
FIG. 1 is depicts a representative scenario in which a monitoring device is paired with multiple items and issues an alert if an item cannot be sensed.

The following detailed description describes various features and functions of the disclosed systems and methods with reference to the accompanying figures. In the figures, similar symbols typically identify similar components, unless context dictates otherwise. The illustrative system and method embodiments described herein are not meant to be limiting. It will be readily understood that certain aspects of the disclosed systems and methods can be arranged and combined in a wide variety of different configurations, all of which are contemplated herein.

A method and monitoring device are described that alert a user who has or is about to misplace, forget, lose, or otherwise have an item removed from the user's presence. The monitoring device monitors the presence of items in its vicinity, using a short-range wireless communication or sensing technology, such as Near Field Communication (NFC), Bluetooth, RuBee, radio-frequency identification (RFID), or any other method of wireless communication or sensing. If the monitoring device is no longer able to detect the presence of the item, thereby implying that the item has been lost, forgotten, stolen, or otherwise missing, the device issues a visual, audible, and/or physical alert to the user. The alert indicates to the user that they may want to search for or retrieve the missing item.

In some embodiments, an item is paired with a monitoring device and the monitoring device issues an alert if the item can no longer be detected by the monitoring device (e.g., the monitoring device can no longer sense or communicate with the item). For example, a mobile phone may be equipped with an RFID reader, and it may monitor an RFID tag attached to and associated with a car key. If the mobile phone attempts to read the RFID tag associated with the key and is unable to, the mobile phone issues an alert.

In some embodiments, an item is paired with a monitoring device and the monitoring device issues an alert if the monitoring device detects that the item is more than a predetermined distance away from the monitoring device and therefore potentially about to go missing. For example, a mobile phone may be equipped with a Bluetooth device, and it may monitor another Bluetooth device attached to and associated with a laptop computer. The mobile phone may monitor both the presence of the laptop computer and the distance that the laptop computer is away from the mobile phone. A monitoring device may utilize various methods to determine the item's distance from the monitoring device. For example, the monitoring device may monitor signal strength to determine when a signal becomes faint or attenuated, or the monitoring device may rely on a communication or sensing technology that allows the calculation of an actual distance between the monitoring device and the item. If the monitoring device determines that the item is more than a predetermined distance away from the mobile phone, it issues an alert. The alert may be the same as or different than the alert that is generated when an item goes missing.

In some embodiments, items are associated with one another and are paired to a monitoring device, and the monitoring device issues an alert if one or more of the items is determined to be missing. The items may be associated with one another manually, or the monitoring device may group items together if it notices that certain items are typically sensed together. For example, a user may ski and may use skis, ski boots, goggles, a helmet, and a jacket every time he skis. RFID tags may be attached to and associated with each of these items, and the items may be paired to a mobile phone that is equipped with an RFID reader. The mobile phone may automatically associate the items with one another when it notices, for example, that the skis, ski boots, goggles, helmet, and jacket are sensed together every Saturday morning. If the mobile phone detects the presence of the skis, goggles, helmet, and jacket, but does not detect the presence of the ski boots, the mobile phone may issue an alert so that the user does not forget the ski boots.

Items may be paired with a monitoring device automatically or manually. In some embodiments, a monitoring device automatically senses the presence of an item and automatically pairs with the item and begins monitoring the item. To identify the item, the monitoring device may include a database of items or may wirelessly connect to a database of items. In some embodiments, a monitoring device automatically senses the presence of an item and asks a user for permission to pair with and monitor the item. In some embodiments, a monitoring device does not automatically sense an item, but instead a user must manually pair the item with the monitoring device.

Various embodiments of the invention will now be described. The following description provides specific details for a thorough understanding and an enabling description of these embodiments. One skilled in the art will understand, however, that the invention may be practiced without many of these details. Additionally, some well-known structures or functions may not be shown or described in detail, so as to avoid unnecessarily obscuring the relevant description of the various embodiments. The terminology used in the description presented below is intended to be interpreted in its broadest reasonable manner, even though it is being used in conjunction with a detailed description of certain specific embodiments of the invention.

FIG. 1 depicts a representative scenario in which a user's 100 mobile phone 110 acts as a monitoring device for multiple items. The mobile phone 110 is equipped with an RFID reader capable of sensing the presence of RFID tags that are attached to and associated with various items, including a purse 120, reading glasses 130, keys 140, and a laptop computer 150. The mobile phone 110 monitors the purse 120, reading glasses 130, keys 140, and laptop computer 150 to ensure that the user 100 has not misplaced or lost the items.

The mobile phone 110 may monitor the items by periodically sensing the presence of the items. The mobile phone 110 may alert the user 100 if it determines that (1) one of the items that is being monitored can no long be detected, or (2) if it detects the absence of an item that is typically present at a certain time, date, or location. As an example of the first scenario, the user 100 may have the mobile phone 110 monitor for the presence of the user's reading glasses 130 to ensure that the user doesn't set her reading glasses down and leave the reading glasses behind. If the mobile phone 110 fails to detect the reading glasses, it generates an alert to notify the user that the reading glasses are no longer present. As an example of the second scenario, the user 100 may take her reading glasses 130 to work every morning at 8:00 a.m. The mobile phone 110 may monitor the presence of the reading glasses every morning from 7:55 a.m. until 8:05 a.m. The user may have configured her mobile phone 110 to monitor the reading glasses 130 between these times, or the mobile phone may have automatically configured this preference by observing patterns associated with the items that it is monitoring. If the mobile phone does not detect the reading glasses 130 during the relevant time period, the mobile phone generates an alert to remind the user that they need to remember to take their reading glasses to work.

In addition to detecting the presence or absence of an item, the mobile phone may also detect when an item exceeds a certain distance from the mobile phone. For example, the user may configure her mobile phone 110 to issue an alert if the mobile phone 110 senses the reading glasses but the reading glasses 130 are more than 100 feet away from the mobile phone. Therefore, if the user walks out her house and walks more than 100 feet away from the reading glasses 130, the mobile phone 110 issues an alert that notifies the user that the glasses have exceeded a desired separation distance.

Figure 2A:
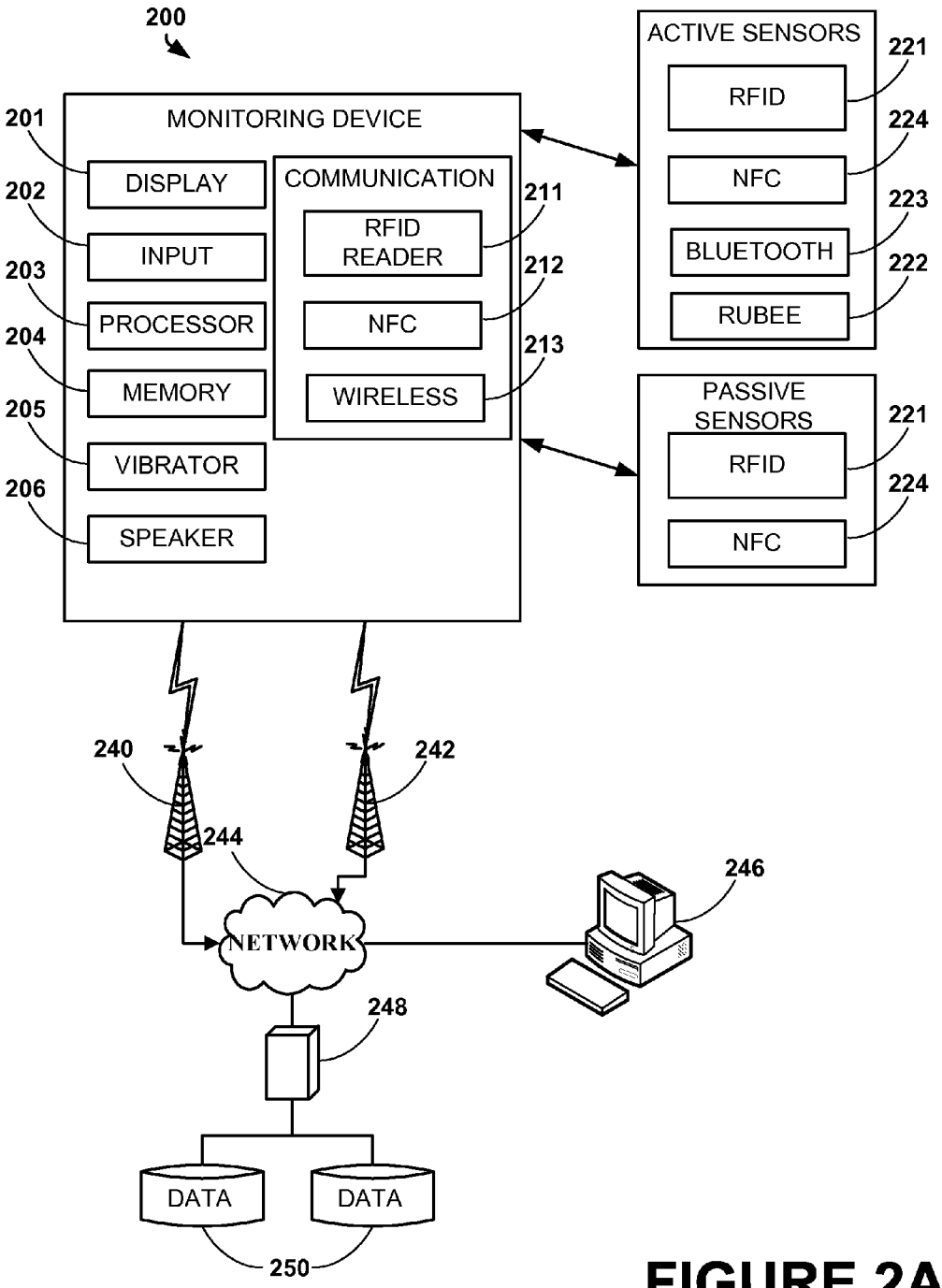
FIG. 2A is a block diagram showing hardware components of a device for monitoring the presence of an item and for issuing an alert if the item is not sensed.

FIG. 2A is a block diagram illustrating hardware components of the monitoring device used to detect the presence of an item, and to issue an alert if the item is missing. In some embodiments, the device may also issue an alert if an item exceeds a desired distance away from the device. Those skilled in the relevant art will appreciate that the invention can be practiced in a variety of mobile (handheld or portable) devices, including: mobile telecommunications devices, personal digital assistants (PDAs), email devices, digital music and video players, portable gaming devices, accessories such as watches, and mobile phones. Such devices have one or more processors for executing software instructions. Aspects of the invention may be stored or distributed on computer-readable media, including magnetically or optically readable computer discs, hard-wired or preprogrammed chips (e.g., EEPROM semiconductor chips), or other data storage media.

As shown in FIG. 2A a monitoring device 200 may be configured to monitor the presence of active sensors 220, passive sensors 230, or both active and passive sensors. The monitoring device 200 typically includes a display component 201, an input component 202, a processor 203, a memory 204, a vibration component 205, and a speaker 206. The display component 201 may be an LCD screen, an OLEO screen, LEOs, or the like, to display an alert and other information to a user. The input component 202 may be a keypad, touch-screen, keyboard, touchpad, or the like. The processor 203 executes instructions stored in the memory 204. The vibration component 205 vibrates the monitoring device to physically alert a user alone, or in conjunction with, an audible alert. The speaker 205 is used to generate an audible alert to the user.

The monitoring device 200 includes one or more communication components 210, such as an RFID reader 211, an NFC communication component 212, and/or another wireless communication component 213, such as a Bluetooth or RuBee component. The communication components 210 may also include components used for other wireless communication protocols, such as G8M, CDMA, GPR8, EDGE, UMT8, IEEE 802.11, IEEE 802.16, etc.

The monitoring device 200 monitors an active sensor 220 or passive sensor 230 that is associated with an item, using any of the aforementioned wireless technologies and protocols. An "active" sensor is a sensor that can autonomously transmit messages to the monitoring device using a communication protocol. Accordingly, the active sensor 220 may include an active RFID tag 221, a RuBee radio tag 222, an active NFC tag 224, a Bluetooth device 223, or the like. A "passive" sensor is a sensor that requires external excitation from the monitoring device to provoke signal transmission to the monitoring device. The passive sensor 230 may include a passive RFID tag 231, a passive NFC tag 232, or the like.

The monitoring device 200 may communicate with servers or other computing devices via a mobile telecommunications network or other wireless telecommunications network. For example, the monitoring device 200 may establish a communication channel with a mobile transceiver 240 using any known standard, such as G8M, CDMA, GPR8, EDGE, UMT8, etc. Alternatively or additionally, the monitoring device 200 may establish a communication channel via a wireless local area network (WLAN) using a wireless hotspot or access point 242. The wireless access point 242 may use any known wireless communication protocols, such as IEEE 802.11 or IEEE 802.16. The monitoring device may communicate with the access point 242 using the Unlicensed Mobile Access (UMA) or the Generic Access network (GAN) protocol. The mobile transceivers and access points are connected via public and/or private networks 244 to remote services operating on a server 248 and other computing devices 246. The server 248 may access data storage areas 250 to obtain or store data.

Figure 2B:
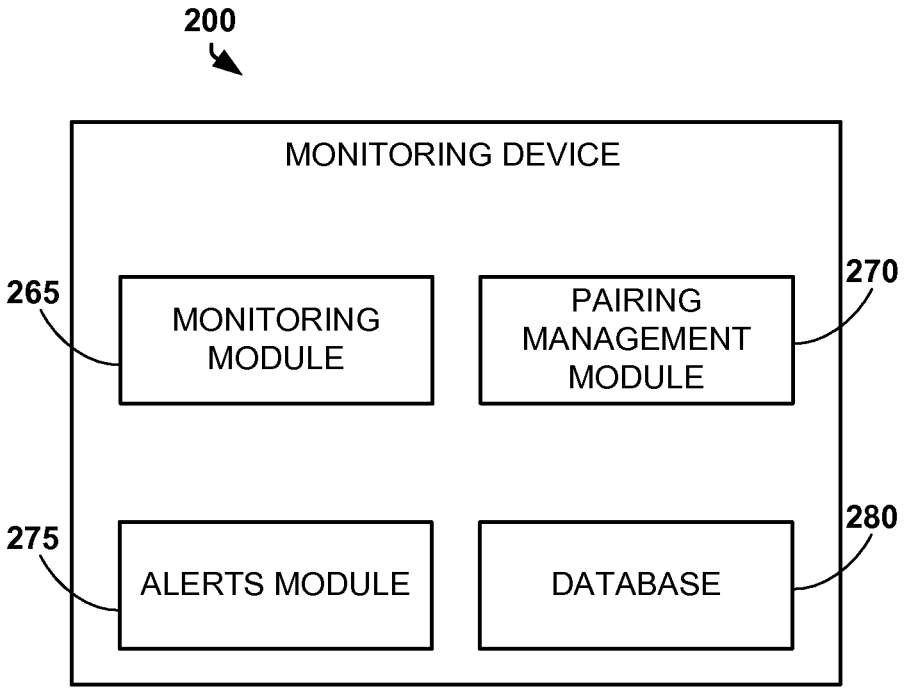
FIG. 2B is a block diagram showing software modules of a device for monitoring the presence of an item and for issuing an alert if the item is not sensed.

FIG. 2B is a block diagram illustrating software components of the monitoring device 200 used to detect the presence of an item, and to issue an alert if the item is not detected. While aspects of the invention, such as certain functions, are described as being performed exclusively on a single device, the invention can also be practiced in distributed environments where functions or modules are shared among disparate processing devices that are linked through a communications network, such as a Local Area Network (LAN), Wide Area Network (WAN), or the Internet. In a distributed computing environment, program modules may be located in both local and remote storage devices and executed by mobile device, server, or other computing device processors.

In FIG. 2B, the monitoring device 200 includes a monitoring module 265, a pairing management module 270, an alerts module 275, and a database 280. The monitoring module 265 enables the monitoring device to communicate with and/or detect passive or active sensors that are associated with items. The monitoring module 265 allows the monitoring device 260 to transmit a signal to the sensor and receive identifying information from the sensor. The monitoring module 265 automatically, or based on manual instruction, detects items having sensors that are in the vicinity of the monitoring device.

The pairing management module 270 manages the pairing of items with the monitoring device 260. The pairing management module 270 may automatically pair with items that are detected by the monitoring module 265, or may prompt the user for permission to pair with a detected item. The pairing management module 270 may also prompt the user for preferences associated with the paired item, such as the type of alert to generate when the item is no longer detected. Alternatively, the pairing management module 270 may apply default or general pairing preferences to paired items.

The alerts module 275 generates alerts associated with missing items. The alerts module 275 determines when the monitoring device 260 should issue an alert, and the type of alert to issue. In determining whether to issue an alert, the alerts module 275 may consider numerous factors, including the nature and type of item that is being monitored, the location of the monitoring device, the date or time, the day of the week, the other items that are being monitored, the other items that had been monitored in the past, the duration of time that the item was sensed, the distance the item is from the monitoring device, the velocity at which the monitoring device is moving relative to the item (either away or toward the item), the preferences of the user, the preferences of other users, trends, or on any other factor.

The database 280 stores data related to currently-monitored or previously monitored items, the monitoring device, the user's preferences, and any other needed data to implement the technology described herein.

Figure 3A:
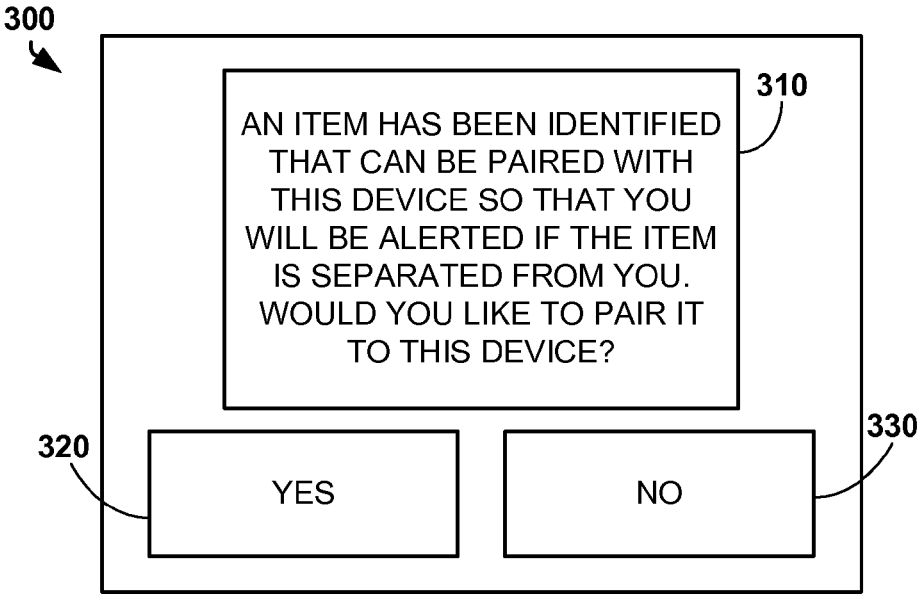
FIG. 3A is a representative interface that is displayed on a monitoring device to allow a user to pair an item to the monitoring device.

FIG. 3A depicts a representative interface 300 that is displayed after the monitoring device has detected an item that could be paired with the monitoring device. A text box 310 is displayed by the monitoring device to alert a user that an item was identified that has not previously been paired with the monitoring device. The monitoring device may identify the type of item from an identification code transmitted by the item, and the text box 310 may therefore describe or otherwise identify the detected item.

The monitoring device may also prompt the user for input relating to the item that has been detected. A "Yes" button 320 and a "No" button 330 allow the user to select whether he or she desires to pair the item to the monitoring device. If the user elects not to pair the item, the monitoring device may prompt the user with additional questions to determine when or if the mobile device should prompt the user to pair the device with the item again. If the user elects to pair the item with the device, the monitoring device may ask the user for his or her alert preferences for the newly paired item.

Figure 3B:
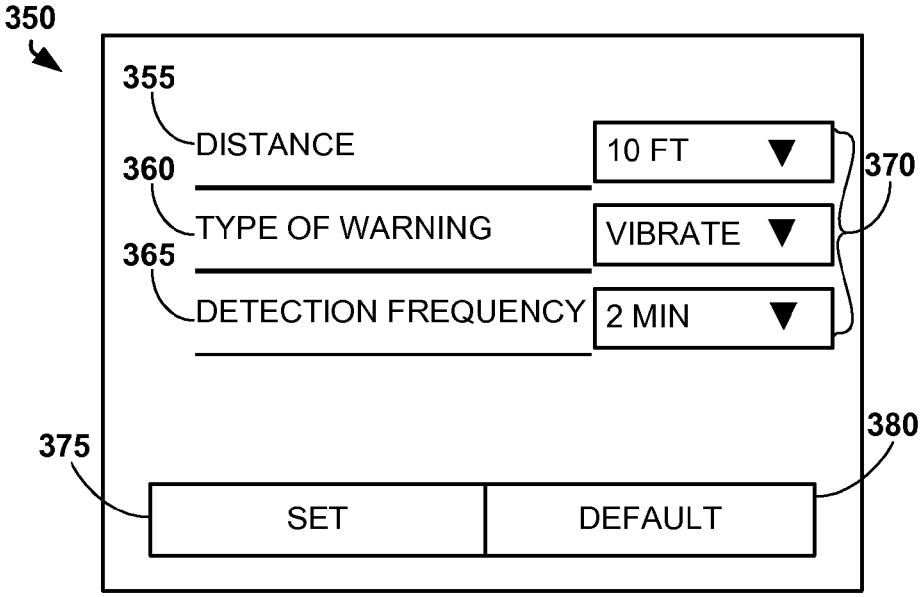
FIG. 3B is a representative interface that is displayed on a monitoring device to allow a user to adjust pairing preferences with respect to an item.

FIG. 3B depicts a representative interface 350 of a pairing preferences menu. The monitoring device may allow a user to adjust pairing preferences after a user elects to pair an item with the monitoring device or if the user elects to edit the pairing preferences. In the depicted example, the monitoring device prompts the user with a "Distance" category 355, a "Type of Warning" category 360, and a "Detection Frequency" category 365. Under the Distance category 355, the user may choose a distance that the item may be separated from the monitoring device before the monitoring device generates an alert. The distance may be manually specified by a user with a number (e.g., 10 feet, 20 meters) or a relative measure (e.g., "short," "medium," "far"). Under the Type of Warning category 360, the user may choose the type of alert that the monitoring device should use to alert the user if the item is determined to be lost or forgotten. For example, the user could select an audible notification, a text notification on the monitoring device or on a different device, an email message to the monitoring device or to a different device, a vibration notification, etc. Under the Detection Frequency category 365, the user may specify the frequency at which the monitoring device should attempt to detect or sense the item. The frequency may be specified by an exact timing (e.g., every minute, every five minutes) or by a relative measure of timing (e.g., "frequently," "infrequently"). To the right of each category are dropdown menus 370 which allow the user to select a value for the categories. In all categories, the user may specify that the monitoring device automatically select an appropriate setting depending on the particular item and other factors.

A "Set" button 375 and a "Default" button 380 are displayed below the categories. The user may select the Set button 375 to set the pairing preferences for the item. The user may select the Default button 380 to return the category values to their default values.

One skilled in the art will appreciate that the monitoring device may monitor multiple items at the same time. The monitoring device may therefore display the representative interfaces depicted in FIGS. 3A and 3B for each item that it detects.

Figure 4:
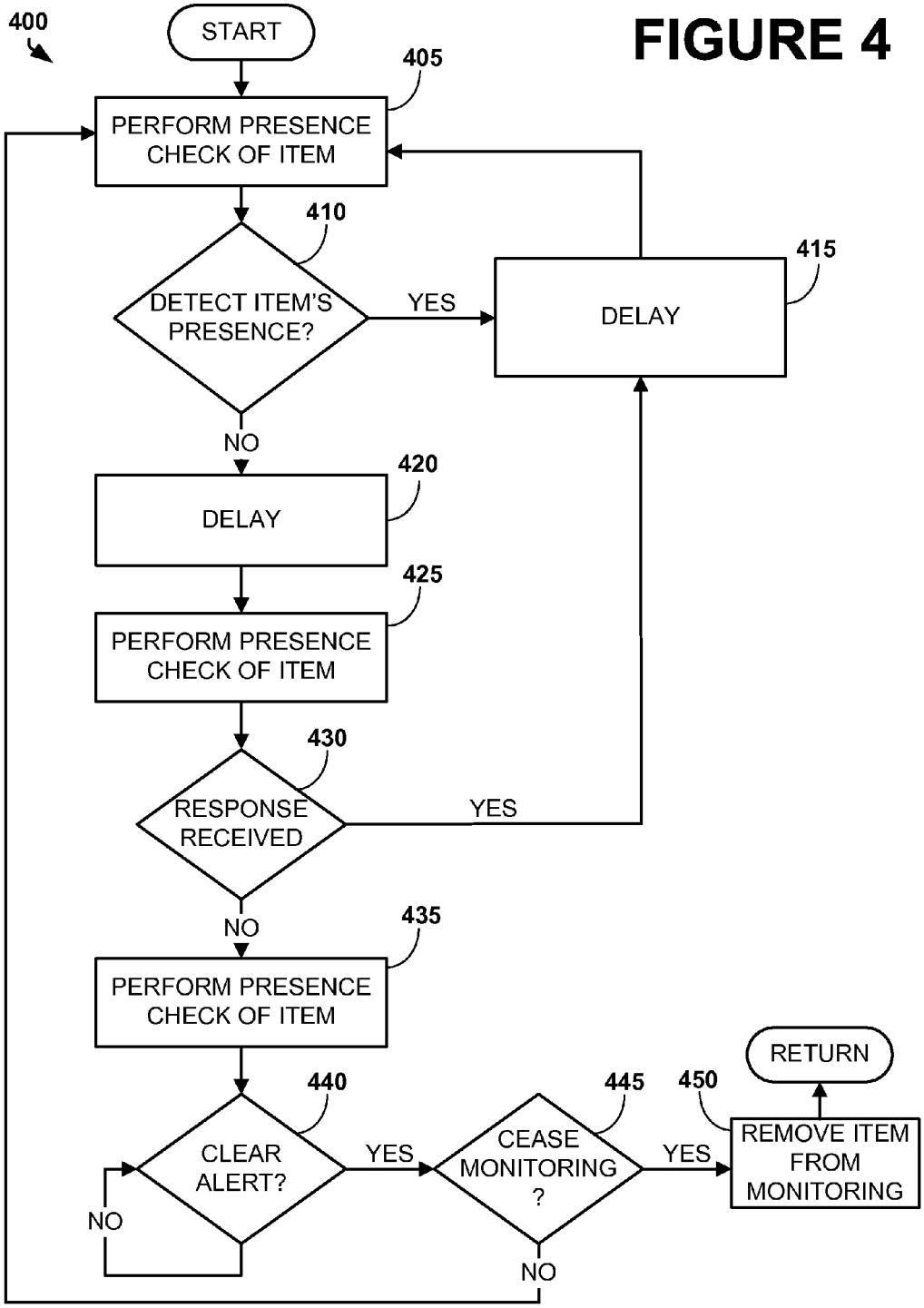
FIG. 4 is a flow diagram showing steps performed by a monitoring device to monitor an item and to issue an alert.

FIG. 4 is a flow diagram of a process 400 implemented by the monitoring device to monitor an item and issue an alert if the item is not detected. The process depicted in FIG. 4 is repeated for each item of a list of items being monitored by the monitoring device.

At a block 405, a monitoring device performs a presence check of an item. If the item is identified and tracked by the user of a passive sensor, the presence check includes transmitting a signal to excite the passive sensor and cause the passive sensor to transmit a corresponding identification number to the monitoring device. For example, if a passive or battery-assisted passive RFID tag is associated with and attached to the item, an RFID reader on the monitoring device must transmit a signal to the RFID tag to elicit the tag's identification information. If the item is identified and tracked by use of an active sensor, the monitoring device may not need to transmit a signal at block 405 to perform a presence check of the item. For example, if an active RFID tag is attached to and associated with an item, the active RFID tag may transmit an identification signal autonomously. Alternatively, the monitoring device may send a query signal to elicit a response from any neighboring active RFID tags. In general, at block 405 the monitoring device attempts to sense the presence of the item by eliciting a signal and/or other identifying information from a sensor associated with the item.

At a decision block 410, the monitoring device determines whether it has detected the item's presence. To do so, the monitoring device compares identification information that it received from sensors associated with a nearby item or items with data identifying the item being monitored. If the received identification information matches the identification information associated with the monitored item, the item has been detected in proximity to the monitoring device and the process proceeds to a block 415. At block 415, the monitoring device delays for a period of time. The delay period is designed to moderate the number of presence checks that are performed by the monitoring device. Moderating the number of presence checks conserves the power of the monitoring device and, in some cases, the sensors. The length of the delay period may depend, for example, on parameters set by a user, the characteristics of the item, the time of day, the day of the week, month, or year, or other factors. For example, a user may be unable to work without his reading glasses. The user may typically leave his house for his office between 7:55 a.m. and 8:05 a.m. During this time period when it is essential that the user not forget his reading glasses, the monitoring device may delay for only a short duration of time (e.g., 30 seconds), enabling the monitoring device to alert the user quickly (e.g., before he drives away from his house) if he has forgotten his reading glasses. However, a short delay period during the user's work day may unduly drain the monitoring device's power because the user is less likely to forget his reading glasses at an inconvenient location, so the process may delay for a longer period of time. In some embodiments, there is no delay period. After the delay period, the process reverts back to block 405 where the monitoring device again checks for the presence of the item.

If the monitoring device does not detect the item at block 410 (i.e., if the received identification information does not match the identification information associated with the monitored item), the process proceeds to a block 420. At block 420, the monitoring device delays for a length of time. The delay period is designed to reduce the likelihood that temporary signal interference, spurious identification information, or temporary misplacement of an item will cause an alert to be generated by the monitoring device. The delay period may depend, for example, on parameters set by a user, the characteristics of the item, the time of day, the day of the week, month, or year, or other factors.

At a block 425, the monitoring device performs a second presence check of the item. At a decision block 430, the monitoring device determines whether it has detected the item's presence. As at decision block 410, the monitoring device compares received identification information with stored identification information associated with the monitored item. If the monitoring device detects the presence of the item, the process proceeds to block 415 where a delay is implemented before rechecking for the presence of the item. If the monitoring device does not detect the presence of the item, i.e., if the received identification information does not match the stored identification information for the item the process proceeds to a block 435.

At block 435, the monitoring device generates an alert to the user. The monitoring device may generate a visual alert with its display component, an audible alert with its speaker component, and/or a physical alert with its vibrator component. The monitoring device may determine which type of alert to generate based on user preference, the type of the item that is no longer detected, or other factors.

It will be appreciated that two attempts to detect an item are made in process 400 before an alert is generated for the user. In some embodiments, the monitoring device may issue an alert after only one attempt to detect the item. For example, a high-value item like a diamond ring may suggest a quicker response time before the generation of an alert. In some embodiments, more than two attempts may be made to detect an item before generating an alert.

At a decision block 440, the monitoring device prompts a user to clear the alert. If the user does not clear the alert, the process returns to decision block 440, and the user is again prompted to clear the alert. In some embodiments, the process delays for a predetermined period of time before again prompting the user to clear the alert. If the user clears the alert, the process proceeds to a decision block 445. At decision block 445, the monitoring device prompts the user as to whether it should cease monitoring the item. If the user elects to continue monitoring the item, the process returns to block 405. In some embodiments, the process delays before returning to block 405. For example, the process may delay until the item has been detected by and re-paired with the monitoring device. If the user elects to cease monitoring the item, the monitoring device stops monitoring the item, and the process continues to a block 450.

At block 450, the monitoring device removes the item from the list of items being monitored. In some embodiments, the monitoring device prompts the user for monitoring parameters that the user may specify. For example, if the user elects to both clear the alert and cease monitoring the item, the monitoring device may prompt the user to cease monitoring related items, or to adjust the user's monitoring preferences with respect to other items that are currently being monitored. Once removed from the list of items being monitored, the device will no longer attempt to detect the presence of the item.

One skilled in the art will appreciate that the aforementioned process may be performed with additional or fewer steps, or with different steps. In some embodiments, the monitoring device does not merely check for the item's presence to determine whether it should issue an alert, but it also monitors the distance the item is away from the device. The monitoring device may calculate the distance that the item is away from the device using numerous methods known in the art. For example, it may determine the distance by measuring the attenuation of the signal strength from the item's sensor. Similarly, the monitoring device may calculate the distance it is away from the item by measuring the time it takes for the monitoring device to transmit a signal to the item and then receive a response from the item.

In deciding whether to issue an alert, the monitoring device may consider the distance of the item and/or a number of other factors, including item characteristics, user preferences, manufacturer or retailer preferences, the presence of other items, or the preferences of other users with respect to the item.

Figure 5:
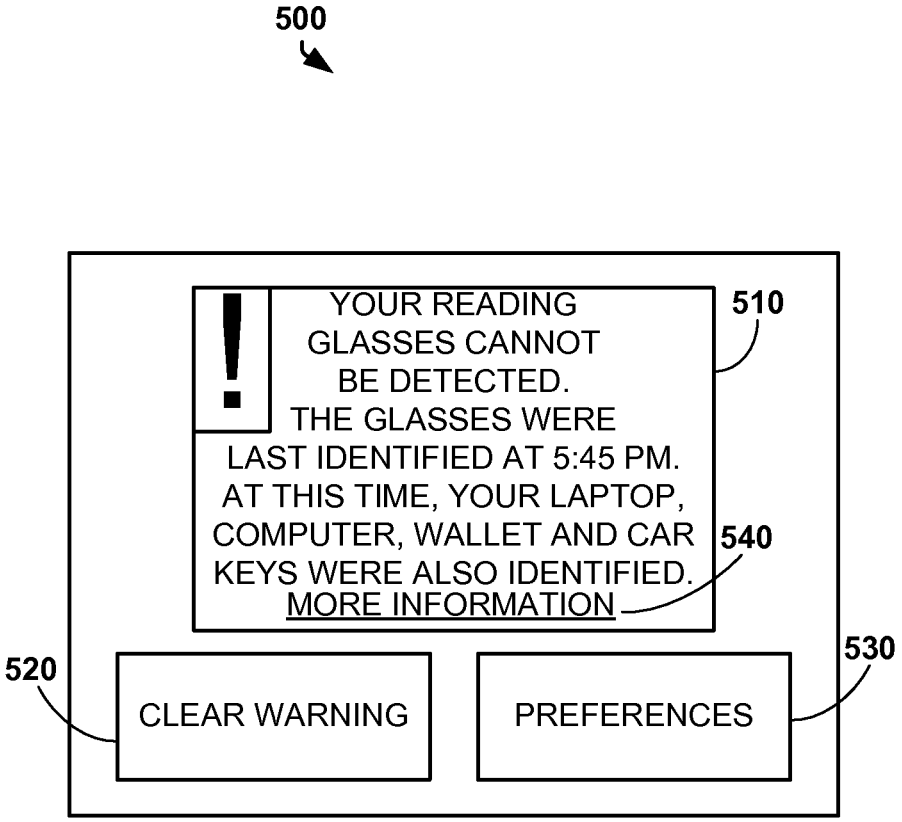
FIG. 5 is a representative interface that is displayed on a monitoring device to alert a user if a monitored item is no longer detected.

FIG. 5 depicts a representative interface 500 that is displayed on a monitoring device to alert a user if a monitored item can no longer be detected. A text box 510 is displayed, warning the user that an item cannot be detected. The text box may also provide the user with information that may help the user identify the item's location. For example, the text box 510 not only states that the user's reading glasses cannot be located, it also states when the glasses were last detected, and provides a description of other items that were detected at the same time. The user may use this information as a way of retracing his or her steps to find the missing item.

The monitoring device also provides a "More Information" button 540. If a user selects the More Information button, the monitoring device displays additional information about the item and the conditions that existed at the time it was last sensed. For example, the monitoring device may provide the location coordinates of the monitoring device when the monitoring device last sensed the item.

The monitoring device also presents a "Clear Warning" button 520 and a "Preferences" button 530 to allow a user to specify how the monitoring device should process the alert. If the user selects the Clear Warning button 520, the monitoring device will remove the alert from the screen. The monitoring device may present further options to the user that would allow, for example, the user to prevent the monitoring device from generating future alerts for the item. If the user selects the Preferences button 530, the monitoring device may present a Pairing Preferences menu 450, as depicted in FIG. 4, or it may present a different preferences menu. The user may then change the timing or format of alerts that are generated by the monitoring device in the future.

In some embodiments, the monitoring device may automatically monitor items temporarily, conditionally, or permanently, or a user may manually specify a time condition. If an item is monitored temporarily, it means that the item is only monitored for a limited time. If an item is monitored conditionally, it means that the item is only monitored under certain conditions, such as during the morning and evening when a user is going to or coming home from work. These monitoring limitations may be determined by the nature or type of item that is being monitored or for other reasons. For example, a monitoring device need not monitor a latte purchased by the user more than 2 hours after the purchase.

In some embodiments, the monitoring device is a pair of sunglasses that a blind user wears. The sunglasses may vibrate or make a sound to alert the blind user that an item paired with the sunglasses can no longer be detected.

In some embodiments, the monitoring device is a hearing aid or the speaker of the monitoring device is included in a hearing aid, and an audible alert is played directly into a user's ear if the user is about to forget or lose an item.

In some embodiments, the monitoring device associates two objects together, and issues an alert if it senses that a user is about to forget a first one of the two objects, but it does not issue an alert if it senses that the user is about to forget only the second one of the two objects. The monitoring device may thus determine the relative importance of specific items. For example, a mobile phone may associate a glasses case and reading glasses together. If the mobile phone detects that the user forgot the glasses case and not the reading glasses, the mobile phone may not issue an alert because a user typically does not need his glasses case if he is wearing his glasses. However, if the mobile phone determines that the user forgot his reading glasses and not the glasses case, the mobile phone may issue an alert if it determines that the glasses are indeed forgotten.

In some embodiments, a monitoring device may monitor whether an item has been sensed and issue an alert if the item has not been sensed by a predetermined time or event. As an example, a user may need to remember a camping tent. The tent may be stored in an attic. The user may set the monitoring device to monitor the tent and may specify that the monitoring device should issue an alert if the user does not have the tent in his or her presence when leaving the house to go camping.

In some embodiments, a user may remotely pair an item with a monitoring device. The user may use a computer, mobile phone, or another communications device and may communicate through a network with the monitoring device to send a command to the monitoring device that pairs it with an item. For example, a child may go to school with a monitoring device and a lunch box. The child's mother may remotely pair the lunchbox with the child's monitoring device so that the child will be alerted if he forgets to bring the lunchbox home from school. Similarly, a teacher may remotely pair homework or books with a student's monitoring device, and the student's monitoring device may alert the student if she forgets her homework or books at home.

In some embodiments, a first monitoring device is used to monitor an item, and a second monitoring device issues an alert if the first monitoring device cannot sense an item. For example, a student may have a monitoring device that monitors a class pet. A teacher may have a monitoring device that communicates with the student's monitoring device over a network or directly. If the student takes the class pet home for a weekend and forgets to bring it back to the classroom on Monday, the teacher may be alerted.

In some embodiments, a monitoring device communicates with a weather service and considers weather data when determining whether to issue an alert.

CONCLUSION

With respect to any or all of the block diagrams and flow charts in the figures as discussed herein, each block and/or communication may represent a processing of information and/or a transmission of information in accordance with example embodiments. Alternative embodiments are included within the scope of these example embodiments. In these alternative embodiments, for example, functions described as blocks, transmissions, communications, requests, responses, and/or message may be executed out of order from that shown or discussed, including substantially concurrent or in reverse order, depending on the functionality involved. Further, more or fewer blocks and/or functions may be used with any of the ladder diagrams, scenarios, and flow charts discussed herein, and these ladder diagrams, scenarios, and flow charts may be combined with one another, in part or in whole.

A block that represents a processing of information may correspond to circuitry that can be configured to perform the specific logical functions of a herein-described method or technique. Alternatively or additionally, a block that represents a processing of information may correspond to a module, a segment, or a portion of program code (including related data). The program code may include one or more instructions executable by a processor for implementing specific logical functions or actions in the method or technique. The program code and/or related data may be stored on any type of computer readable medium such as a storage device including a disk or hard drive or other storage medium.

The computer readable medium may also include non-transitory computer readable media such as computer-readable media that stores data for short periods of time like register memory, processor cache, and random access memory (RAM). The computer readable media may also include non-transitory computer readable media that stores program code and/or data for longer periods of time, such as secondary or persistent long term storage, like read only memory (ROM), optical or magnetic disks, compact-disc read only memory (CD-ROM), for example. The computer readable media may also be any other volatile or non-volatile storage systems. A computer readable medium may be considered a computer readable storage medium, for example, or a tangible storage device.

Moreover, a block that represents one or more information transmissions may correspond to information transmissions between software and/or hardware modules in the same physical device. However, other information transmissions may be between software modules and/or hardware modules in different physical devices.

It should be understood that for situations in which the systems and methods discussed herein collect personal information about users, the users may be provided with an opportunity to opt in/out of programs or features that may collect personal information (e.g., information about a user's preferences or a user's contributions to social content providers). In addition, certain data may be anonymized in one or more ways before it is stored or used, so that personally identifiable information is removed. For example, a user's identity may be anonymized so that the no personally identifiable information can be determined for the user and so that any identified user preferences or user interactions are generalized (for example, generalized based on user demographics) rather than associated with a particular user.

While various aspects and embodiments have been disclosed herein, other aspects and embodiments will be apparent to those skilled in the art. The various aspects and embodiments disclosed herein are for purposes of illustration and are not intended to be limiting.

What is claimed is:

1. A computer-implemented method comprising:

determining, by a monitoring device, that presence data associated with a first item meets one or more criteria associated with adding the first item to a first list of items whose presence is monitored in a first particular context;

in response to determining that presence data associated with the first item meets the one or more criteria associated with adding the first item to the first list of items whose presence is monitored in the first particular context, adding the first item to the first list of items whose presence is monitored in the first particular context;

determining whether the monitoring device meets one or more first context criteria for the first particular context;

determining, when the monitoring device meets the one or more first context criteria for the first particular context, whether the first item is located within a first predetermined distance of the monitoring device;

determining a type of alert for the first item using the first predetermined distance in response to determining that the first item is not within the first predetermined distance of the monitoring device;

providing, by the monitoring device, the type of alert for the first item in response to determining the type of alert for the first item using the first predetermined distance;

determining whether the monitoring device meets one or more second context criteria for a second particular context different from the first particular context;

determining, when the monitoring device meets the one or more second context criteria for the second particular context, whether a second item is located within a second predetermined distance of the monitoring device, the second item being on a second list of items whose presence is monitored in the second particular context, the second list of items being a different list of items than the first list of items; and not providing an alert regarding the second item in response to determining that the second item is within the second predetermined distance of the monitoring device.

2. The method of claim 1, wherein determining that presence data associated with the first item meets the one or more criteria associated with adding the first item to the list of items whose presence is monitored in the first particular context comprises determining that presence data associated with the first item meets the one or more criteria associated with adding the first item to the first list of items whose presence is monitored at a particular time of day.

3. The method of claim 1, wherein determining that presence data associated with the first item meets the one or more criteria associated with adding the item to the first list of items whose presence is monitored in the first particular context comprises determining that presence data associated with the first item meets the one or more criteria associated with adding the first item to the first list of items whose presence is monitored at a particular location.

4. The method of claim 1, further comprising:

identifying other items that were located within a predetermined distance of the monitoring device when the first item was last detected by the monitoring device, wherein providing the type of alert for the first item comprises providing information about the other items.

5. The method of claim 1, further comprising:

determining a most recent location of the monitoring device when the first item was last detected by the monitoring device, wherein providing the type of alert for the first item comprises providing information about the most recent location when the first item was last detected.

6. The method of claim 1, further comprising:

determining a most recent time when the first item was last detected by the monitoring device, wherein providing the type of alert for the first item comprises providing information about the time when the first item was last detected.

7. The method of claim 1, further comprising:

providing a prompt requesting verification that the first item should be added to the first list of items whose presence is monitored in the first particular context; and receiving input verifying that the first item should be added to the first list of items whose presence is monitored in the first particular context, wherein adding the first item to the first list of items whose presence is monitored in the first particular context is in response to receiving the input.

8. A system comprising:

one or more computers and one or more storage devices storing instructions that are operable, when executed by the one or more computers, to cause the one or more computers to perform operations comprising:

determining that presence data associated with a first item meets one or more first criteria associated with adding the first item to a first list of items whose presence is monitored in a first particular context;

in response to determining that presence data associated with the first item meets the one or more first criteria associated with adding the first item to the first list of items whose presence is monitored in the first particular context, providing a prompt requesting user verification that the first item should be added to the first list of items whose presence is monitored in the first particular context;

in response to providing the Prompt requesting user verification that the first item should be added to the first list of items whose presence is monitored in the first particular context, receiving first user input verifying that the first item should be added to the first list of items whose presence is monitored in the first particular context;

adding the first item to the first list of items whose presence is monitored in the first particular context in response to receiving the first user input;

determining that presence data associated with a second item meets one or more second criteria associated with adding the second item to a second list of items whose presence is monitored in a second particular context different from the first particular context, the second list of items being a different list of items than the first list of items;

in response to determining that presence data associated with the second item meets the one or more second criteria associated with adding the second item to the second list of items whose presence is monitored in the second particular context, providing a prompt requesting user verification that the second item should be added to the second list of items whose presence is monitored in the second particular context;

in response to providing the prompt requesting user verification that the second item should be added to the second list of items whose presence is monitored in the second particular context, receiving second user input verifying that the second item should be added to the second list of items whose presence is monitored in the second particular context; and adding the second item to the second list of items whose presence is monitored in the second particular context in response to receiving the second user input.

9. The system of claim 8, wherein determining that presence data associated with the first item meets the one or more criteria associated with adding the first item to the list of items whose presence is monitored in the first particular context comprises determining that presence data associated with the first item meets the one or more criteria associated with adding the first item to the first list of items whose presence is monitored at a particular time of day.

10. The system of claim 8, wherein determining that presence data associated with the first item meets the one or more criteria associated with adding the item to the first list of items whose presence is monitored in the first particular context comprises determining that presence data associated with the first item meets the one or more criteria associated with adding the first item to the first list of items whose presence is monitored at a particular location.

11. The system of claim 8, the operations further comprising:

determining whether the first item is located within a predetermined distance of the system; and providing an alert regarding the first item based on determining that the first item is not within the predetermined distance of the system.

12. The system of claim 11, the operations further comprising:

determining whether the system meets one or more context criteria for the first particular context, wherein providing the alert regarding the first item comprises providing the alert when the system meets the one or more context criteria for the first particular context.

13. The system of claim 11, the operations further comprising:

determining a most recent location of the system when the first item was last detected by the system, wherein the alert regarding the first item comprises information about the most recent location when the first item was last detected.

14. A non-transitory computer-readable medium storing software comprising instructions executable by one or more computers which, upon such execution, cause the one or more computers to perform operations comprising:

determining, by the one or more computers, that presence data associated with an first item meets one or more first criteria associated with adding the first item to a first list of items whose presence is monitored in a first particular context; and based on determining that presence data associated with the first item meets the one or more first criteria associated with adding the first item to the first list of items whose presence is monitored in the first particular context, adding the first item to the first list of items whose presence is monitored in the first particular context;

determining whether the one or more computers meet one or more first context criteria for the first particular context;

determining, when the one or more computers meet the one or more first context criteria for the first particular context, whether the first item is located within a first predetermined distance of the one or more computers;

determining a type of alert for the first item using the first predetermined distance in response to determining that the first item is not within the first predetermined distance of the one or more computers;

providing, by the one or more computers, the type of alert for the first item in response to determining the type of alert for the first item using the first predetermined distance;

determining whether the one or more computers meet one or more second context criteria for a second particular context different from the first particular context;

determining, when the one or more computers meet the one or more second context criteria for the second particular context, whether a second item is located within a second predetermined distance of the one or more computers, the second item being on a second list of items whose presence is monitored in the second particular context, the second list of items being a different list of items than the first list of items; and not providing an alert regarding the second item in response to determining that the second item is within the second predetermined distance of the one or more computers.

15. The computer-readable medium of claim 14, wherein determining that presence data associated with the first item meets the one or more criteria associated with adding the first item to the list of items whose presence is monitored in the first particular context comprises determining that presence data associated with the first item meets the one or more criteria associated with adding the first item to the first list of items whose presence is monitored at a particular time of day.

16. The computer-readable medium of claim 14, wherein determining that presence data associated with the first item meets the one or more criteria associated with adding the item to the first list of items whose presence is monitored in the first particular context comprises determining that presence data associated with the first item meets the one or more criteria associated with adding the first item to the first list of items whose presence is monitored at a particular location.

17. The method of claim 1, wherein determining that presence data associated with the first item meets the one or more criteria associated with adding the first item to the first list of items whose presence is monitored in the first particular context comprises determining that presence data associated with the first item meets the one or more criteria associated with adding the first item to the first list of items whose presence is monitored upon detection of another item on the first list of items.

18. The method of claim 1, wherein:

determining, when the monitoring device meets the one or more first context criteria for the first particular context, whether the first item is located within the first predetermined distance of the monitoring device comprises determining, when the monitoring device meets the one or more first context criteria for the first particular context, whether a particular item is located within the first predetermined distance of the monitoring device; and determining, when the monitoring device meets the one or more second context criteria for the second particular context, whether the second item is located within the second predetermined distance of the monitoring device comprises determining, when the monitoring device meets the one or more second context criteria for the second particular context, whether the particular item is located within the second predetermined distance of the monitoring device, the particular item being included in the first list of items and the second list of items.

19. The system of claim 8, wherein determining that presence data associated with the first item meets the one or more criteria associated with adding the first item to the first list of items whose presence is monitored in the first particular context comprises determining that presence data associated with the first item meets the one or more criteria associated with adding the first item to the first list of items whose presence is monitored upon detection of another item on the first list of items.

20. The system of claim 8, wherein:

determining that presence data associated with the first item meets the one or more first criteria associated with adding the first item to the first list of items whose presence is monitored in the first particular context comprises determining that presence data associated with a particular item meets the one or more first criteria associated with adding the particular item to the first list of items whose presence is monitored in the first particular context; and determining that presence data associated with the second item meets the one or more second criteria associated with adding the second item to the second list of items whose presence is monitored in the second particular context different from the first particular context comprises determining that presence data associated with the particular item meets the one or more second criteria associated with adding the particular item to the second list of items whose presence is monitored in the second particular context different from the first particular context.

21. The method of claim 1, wherein determining the type of alert for the first item using the first predetermined distance comprises determining the type of alert for the first item using a type of the first item.

22. The method of claim 1, wherein determining the type of alert for the first item using the first predetermined distance comprises determining the type of alert for the first item using a minimum distance between the monitoring device and the first item.

23. The system of claim 8, the operations comprising:

providing a prompt requesting alert preferences for the first item to use when the first item is not detected in the first particular context; and receiving third input indicating the alert preferences for the first item to use when the first item is not detected in the first particular context.

24. The system of claim 23, wherein providing the prompt requesting alert preferences for the first item to use when the first item is not detected in the first particular context is responsive to receiving the first input.

25. The system of claim 24, wherein adding the first item to the first list of items whose presence is monitored in the first particular context is responsive to receiving the third input.

* * * * *